US006757516B2

(12) United States Patent
Miura

(10) Patent No.: US 6,757,516 B2
(45) Date of Patent: Jun. 29, 2004

(54) CARRYING APPARATUS AND IMAGE FORMING APPARATUS

(75) Inventor: Tatsuyuki Miura, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/397,528

(22) Filed: Mar. 27, 2003

(65) Prior Publication Data

US 2003/0185611 A1 Oct. 2, 2003

Related U.S. Application Data

(63) Continuation of application No. 09/922,654, filed on Aug. 7, 2001, now Pat. No. 6,549,748.

(51) Int. Cl.[7] ..... G03G 15/00

(52) U.S. Cl. ..... 399/401; 399/16; 399/18; 399/381

(58) Field of Search ..... 399/1, 16, 18, 399/19, 20, 21, 79, 81, 124, 381, 388, 397, 401

(56) References Cited

U.S. PATENT DOCUMENTS

| | | | |
|---|---|---|---|
| 4,750,020 | A | 6/1988 | Ishizu et al. |
| 4,878,087 | A | 10/1989 | Sakai et al. |
| 5,030,991 | A | 7/1991 | Zaitsu et al. |
| 6,089,560 | A | 7/2000 | Fujiwara |
| 6,125,251 | A | 9/2000 | Shiraishi et al. |
| 6,275,676 | B1 | 8/2001 | Ushio |

FOREIGN PATENT DOCUMENTS

| | | | |
|---|---|---|---|
| JP | 7-248704 | A | 9/1995 |

*Primary Examiner*—Sandra Brase
(74) *Attorney, Agent, or Firm*—Foley & Lardner LLP

(57) ABSTRACT

The carrying apparatus comprises a carrying device for carrying an object to be carried, along a carrying route having a straight part and an arc-like corner part, a straight escape part provided in the carrying device, and a control device for letting the object carried along the carrying route escape temporarily to the escape part and for keeping it therein, if necessary.

9 Claims, 19 Drawing Sheets

CARRYING APPARATUS AND IMAGE FORMING APPARATUS

The present application is a continuation of U.S. application Ser. No. 09/922,654, filed Aug. 7, 2001, the contents of which are incorporated herein by reference.

BACKGROUND OF THE INVENTION

The present invention relates to a carrying apparatus and an image forming apparatus which are comprised in, for example, an electrophotographic copying machine carrying paper sheets.

In some electrophotographic copying machines, images can be formed on both surfaces of a paper sheet. When images are formed on both surfaces of a paper sheet in these electrophotographic copying machines, paper sheets are fed from a sheet feed cassette through a sheet carrying route to an image forming section (hereinafter called simply an ADU). An image is formed on the front surface of the paper sheet thus fed to the image forming section and is then once stacked and contained into an intermediate tray. Subsequently, the paper sheet thus stacked and contained in the intermediate tray is fed again to the image forming apparatus, with its surfaces reversed. An image is then formed on its back surface. In this manner, images are formed on both surfaces of the paper sheet which is then discharged onto a sheet discharge tray.

Paper sheets stacked on the intermediate tray are applied with static electricity.

Meanwhile, electrostatic charges have been applied to paper sheets stacked on the intermediate tray, for example, through a transfer process at the image forming section. Therefore, paper sheets easily tend to be fed stuck to each other due to static electricity, when they are fed again from the intermediate tray.

In addition, since a paper sheet having a surface on which an image has been formed must once be stacked and contained in the intermediate tray, an image cannot be formed sequentially on its back surface. Time loss is hence caused so that the image forming efficiency is lowered.

To solve the above-described problems of paper sheets being fed stuck to each other and the image forming efficiency being lowered, development has been made in an electrophotographic copying machine which adopts a so-called non-stack ADU.

In this kind of electrophotographic copying machine, the intermediate tray is excluded from the ADU. Images are formed sequentially on the surfaces of a plurality of sheets. Thereafter, these paper sheets are directly sent to the image forming section, reversed by a reverse carrying means, and images are formed on the back surfaces of the paper sheets.

In some cases, the non-stack ADU is used with an accounting device such as a coin controller attached to the ADU. If a total of 4 pages are double-side-printed on two paper sheets in an electrophotographic copying machine attached with the accounting device, for example, there may be a case that the inserted money runs short at the time point when printing on pages 1, 2, and 4 pages is finished.

In this case, the paper sheet on which the third page should be printed is discharged without carrying out printing, or is kept on the ADU in the conventional apparatus.

It is, however, unkind to users to discharge the paper sheets without completing the printing process.

On the other hand, if a paper sheet is kept on the ADU, it may be curled if it is positioned in the corner section of the ADU.

Further, if a paper sheet is kept in a fixing device in an apparatus in which the sheet reverse mechanism serves also the fixing device, the paper sheet may be burnt, emit smoke, or catch fire.

Meanwhile, the non-stack ADU can be opened/closed in accordance with the operation of opening/closing an open/close door. If a paper sheet jams while carrying the paper sheet, the open/close door can be opened to remove the paper sheet. Therefore, if the door is opened with a paper sheet still kept on the ADU, there is a drawback that the paper sheet kept on the ADU falls to the ground and gets dirty.

BRIEF SUMMARY OF THE INVENTION

The present invention has been made in view of the situation described above and has an object of providing a carrying apparatus and an image forming apparatus capable of keeping a transfer object (to which an image should be transferred), without curling or burning it or dropping it when an open/close door is opened.

A carrying apparatus according to the present invention comprises: a carrying device for carrying an object to be carried, along a carrying route having a straight part and an arc-like corner part; a straight escape part provided in the carrying device; and a control device for letting the object carried along the carrying route escape temporarily to the escape part and for keeping it therein, if necessary.

An image forming apparatus according to the present invention comprises: an image forming device for forming an image on an image carrier; a transfer device for transferring the image formed by the image forming device, to a transfer object to which the image should be transferred; a reverse carrying device for carrying the transfer object having one surface to which the image has been transferred, along a reverse carrying route having a straight part and an arc-like corner part, to reverse the transfer object, and for feeding the transfer object again to the transfer device to transfer an image to another surface thereof; a straight escape part provided in the reverse carrying device; and a control device for letting a carrying object to be carried, which is carried along the reverse carrying route, escape temporarily to the escape part, and for keeping the carrying object therein, if necessary.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the embodiments given below, serve to explain the principles of the invention.

DETAILED DESCRIPTION OF THE INVENTION

Figure 1:
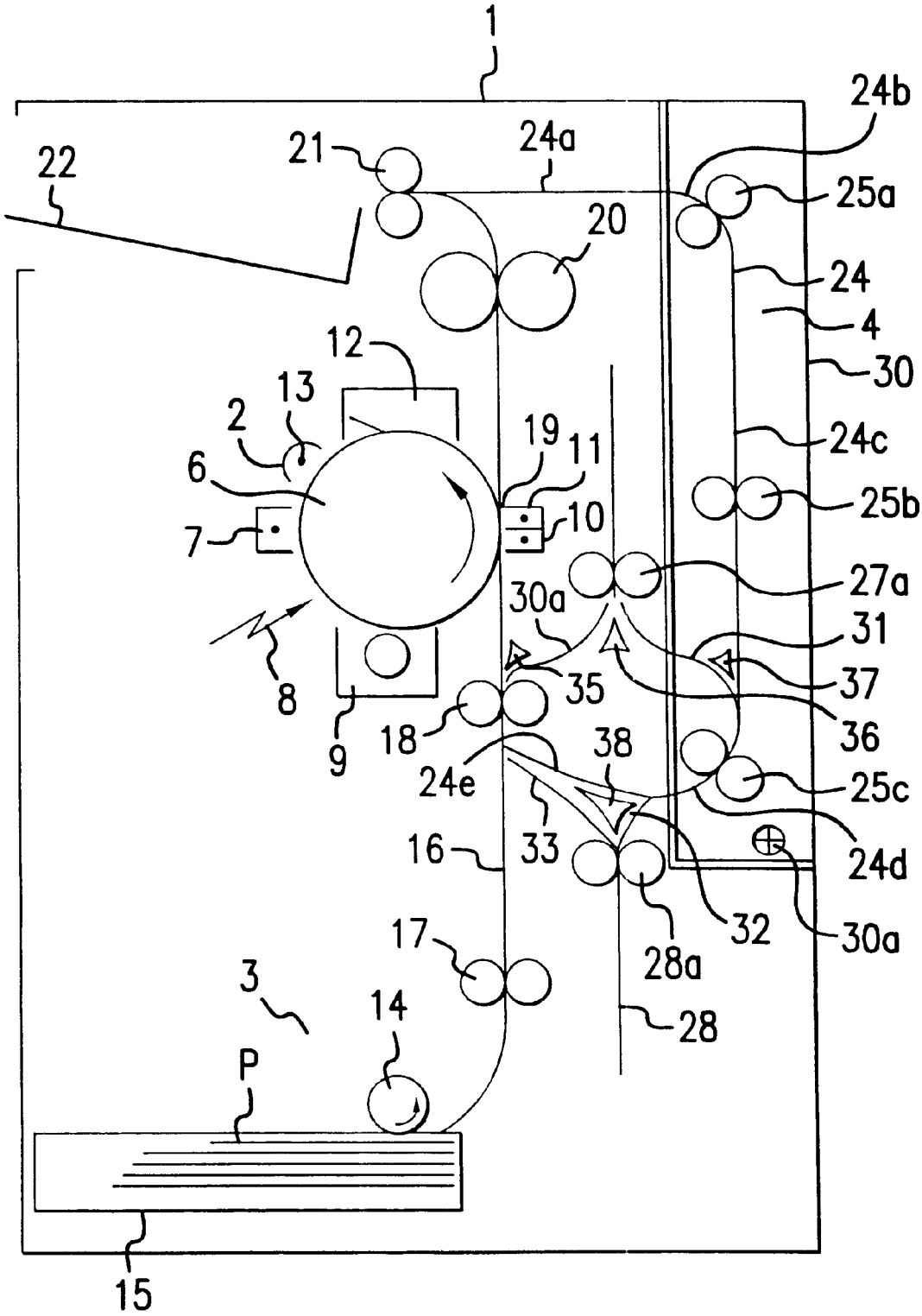
FIG. 1 is a schematic structural view showing an electrophotographic copying machine according to an embodiment of the present invention.
Figure 2:
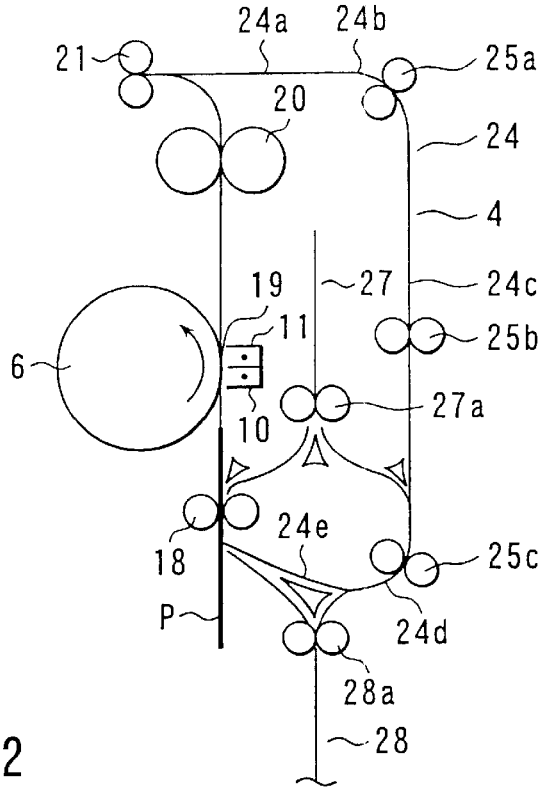
FIG. 2 is a view showing a state in which a paper sheet is being fed to an image transfer section.

In the following, the present invention will be explained with reference to an embodiment shown in the drawings.

FIG. 1 is a structural view showing an electrophotographic machine as an image forming apparatus according to an embodiment of the present invention.

The electrophotographic machine 1 comprises an apparatus body 1. An image forming section 2 for forming an image on a paper sheet as an object to be carried (e.g., a transfer-target material) in an electrostatic photographic method, a sheet feeder 3 for carrying and supplying a paper sheet for the image forming section 2, and a reverse carrying apparatus 4 for turning over the paper sheet and for returning the paper sheet to the sheet feeder 3. Since the reverse carrying apparatus 4 does not comprise an intermediate tray, the apparatus serves as a so-called non-stack ADU.

The image forming section 2 comprises a rotatable photosensitive drum 6 as an image carrier. Provided in the peripheral part of the photosensitive drum 6 are members for executing a so-called electrostatic photographic process by means of a process CPU (not shown).

More specifically, the photosensitive drum 6 is constructed by an application type OPC charged in the minus polarity, and this photosensitive drum 6 includes a conductive base member and a photosensitive layer covering the surface of the conductive base member. The photosensitive layer has a film thickness of 15 to 30 $\mu$m and a dielectric constant of 2.0 to 5.0. The conductive base member of the photosensitive drum 6 is grounded.

Provided in the peripheral part of the photosensitive drum 6 along its rotating direction are a charger 7, a scanning optical system (not shown) for emitting imaging light 8, a developing device 9, a transfer device 10, a separator 11, a cleaning device 12, and a discharger 13.

The sheet feeder 3 includes a sheet feed cassette 15 and a main carrying route 16 for carrying a paper sheet supplied from the sheet feed cassette 15 upwards. Paper sheets P are contained in the sheet feed cassette 15, and are fed one after another by rotation of the sheet feed roller 14.

The main carrying route 16 is provided along the vertical direction. Paired carrying rollers 17, paired resist rollers 18, an image transfer section 19, paired fixing rollers 20, and paired discharge rollers 21 are provided respectively from the side of the lower part to the side of the upper part on the main carrying route 16. A sheet discharge tray 22 is provided on the side of the paired discharge rollers 21 in which paper sheets are discharged.

The reverse carrying device 4 has a reverse carrying route 24 which connects the sheet discharge side of the paired rollers 20 with the sheet introducing side of the paired resist rollers 18. The reverse carrying route 24 is constructed by a horizontal part 24*a* as a straight part in the upper side, a curved corner part 24*b*, a vertical part 24*c*, a curved corner part 24*d* in the lower side, and a slanting part 24*e*. The corner part 24*b* in the upper side, the vertical part 24*c*, and the corner part 24*d* in the lower side are respectively provided with pairs of carrying rollers 25*a*, 25*b*, and 25*c*.

In addition, the reverse carrying device 4 has an open/close door 30 for opening/closing the reverse carrying route 24. The open/close door 30 is rotatably supported, in its lower side, on the apparatus body 1 by a support shaft.

Meanwhile, upper and lower escape parts 27 and 28 for temporarily escaping and holding a paper sheet are provided between the main carrying route 16 and the reverse carrying route 24. The upper and lower escape parts 27 and 28 are constructed to be straight along the vertical direction. The upper and lower escape parts 27 and 28 are provided respectively with pairs of input/output rollers 27*a* and 28*a* for inputting/outputting a paper sheet.

The paired carrying rollers 18 on the main carrying route 16 and the paired rollers 27*a* of the upper escape part 27 are connected with each other through a first connection route 30*a*. The paired rollers 27*a* of the upper escape part 27 and the paired carrying rollers 25*c* in the lower side of the reverse carrying route 24 are connected with each other through a second connection route 31. The paired carrying rollers 25*c* in the lower side and the paired rollers 28*a* of the lower escape part 28 are connected with each other through a third connection route 32. The paired rollers 28*a* of the lower escape part 28 and the paired carrying rollers 18 on the main carrying route 16 are connected with each other through a fourth connection route 33.

A first gate 35 for switching the carrying direction of a paper sheet P to the main carrying route 16 or the first connection route 30*a* is provided in the upper side of the paired carrying rollers 18 on the main carrying route 16. A second gate 36 for switching the carrying direction of the paper sheet P to the first connection route 30*a* or the second connection route 31 is provided in the lower side of the paired rollers 27*a* of the upper escape part 27. A fourth gate 38 for switching the carrying direction of a paper sheet P fed out from the corner part 24*d* in the lower side of the reverse carrying route 24 to the third connection route 32 or the slanting part 24*e* and for guiding a paper sheet P fed out from the lower escape part 28 to the fourth connection route 33 is provided in the upper side of the paired rollers 28*a* of the lower escape part 28. Further, a third gate 37 for switching the carrying direction of a paper sheet P fed out by reverse rotation of the paired carrying rollers 25*c* to the reverse carrying route 24 or the second connection route 31 is provided in the upper side of the paired carrying rollers on the reverse carrying route 24.

Figure 10:
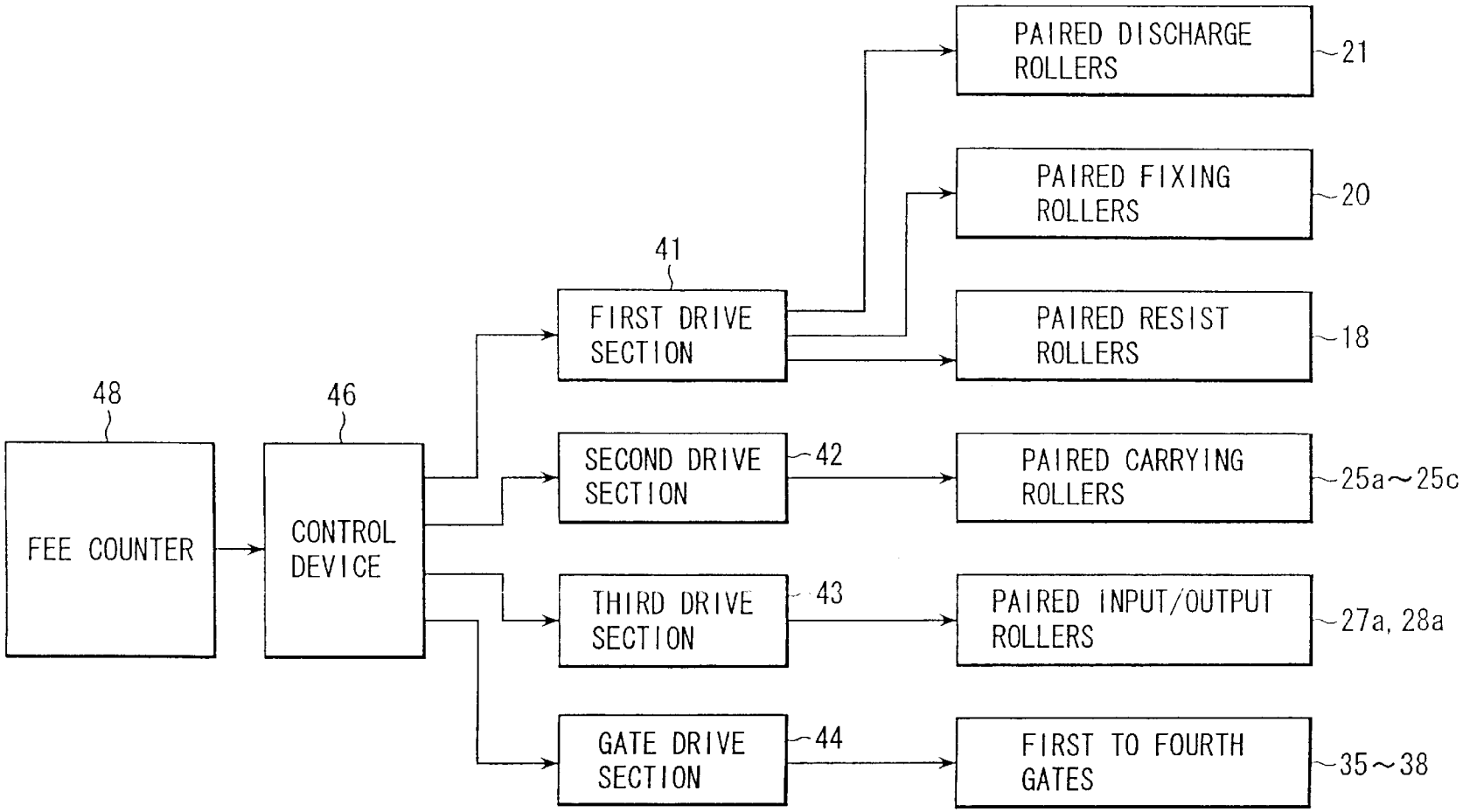
FIG. 10 is a block diagram showing the drive control system of the sheet carrying apparatus.

FIG. 10 is a block diagram showing the drive control system of the main carrying route 16, the reverse carrying route 24, the upper and lower escape parts 27 and 28, and the first to fourth gates 35 to 38.

That is, the paired resist rollers 18, the paired fixing rollers 20, and the discharge rollers 21 which are provided on the main carrying route 16 are rotated in regular and reverse directions by a first drive section 41. The paired carrying rollers 25*a* to 25*c* provided on the reverse carrying route 24 are rotated in the regular and reverse directions by a second drive section 42. The paired input/output rollers 27*a* and 27*b* provided for the upper and lower escape parts 27 and 28 are rotated in the regular and reverse directions by a third drive section 43. The first to fourth gates 35 to 38 are rotated and operated by a gate drive section 44.

The first to third drive sections 41 to 43 and the gate drive section 44 are connected to a control device 46, which is connected with a fee counter 48 through a signal route.

The fee counter 48 is attached to an accounting device such as a coin controller or the like which will be explained later. The fee counter 48 counts inserted money and calculates the balance of use fee.

The control device 46 receives a money insertion signal or a no-balance signal concerning the fee from the fee counter 48, thereby to control driving of the first to third drive sections 41 to 43 and driving of the gate drive section 44.

Next, explanation will be made of double-side image forming operation with reference to FIGS. 1 to 9.

When forming images on both sides, the surface of the photosensitive drum 6 is charged by the charger 7 at first, and imaging light 8 is irradiated on the, surface of the charged photosensitive drum 6, so that an electrostatic latent image corresponding to an original document image is formed on the surface of the charged photosensitive drum 6. This electrostatic latent image is sent to the developing device 9 by rotation of the photosensitive drum 6 and is supplied with magnetic toner as a developing agent from the developing device 9, to form a magnetic toner image.

Figure 3:
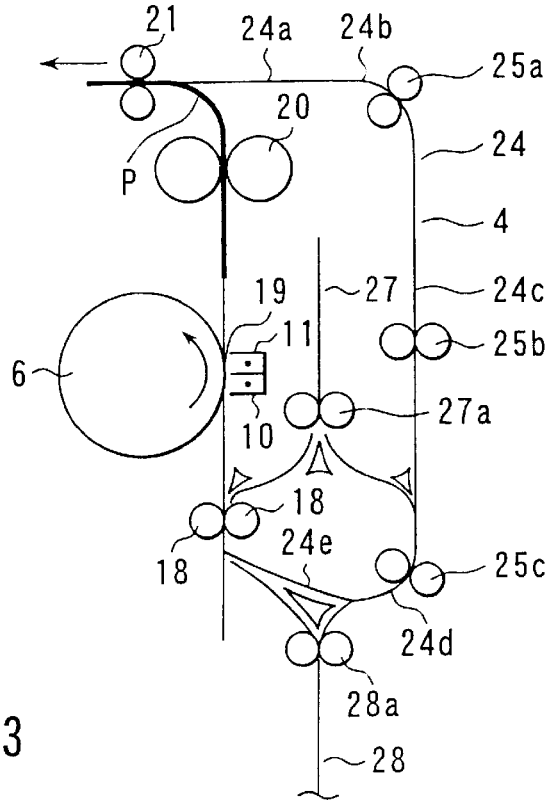
FIG. 3 is a view showing a state in which a paper sheet is being fed out from the image transfer section with an image transferred thereto.

At this time, a paper sheet P is supplied by rotation of the sheet feed roller 14 and is clamped and carried by the paired carrying rollers 17. This paper sheet P is aligned by the paired resist rollers 18 and is thereafter supplied to the image transfer section 19 between the photosensitive drum 6 and the transfer device 10. Here, the magnetic toner image on the photosensitive drum 6 is transferred to the paper sheet P. The paper sheet P on which the magnetic toner image has been transferred is separated from the photosensitive drum 6 and carried by the operation of the separator 11. As shown in FIG. 3, this paper sheet P is then supplied to the paired fixing rollers 20 where the transferred toner image is fixed to the paper sheet P and is fed out toward the discharge tray 22.

Figure 4:
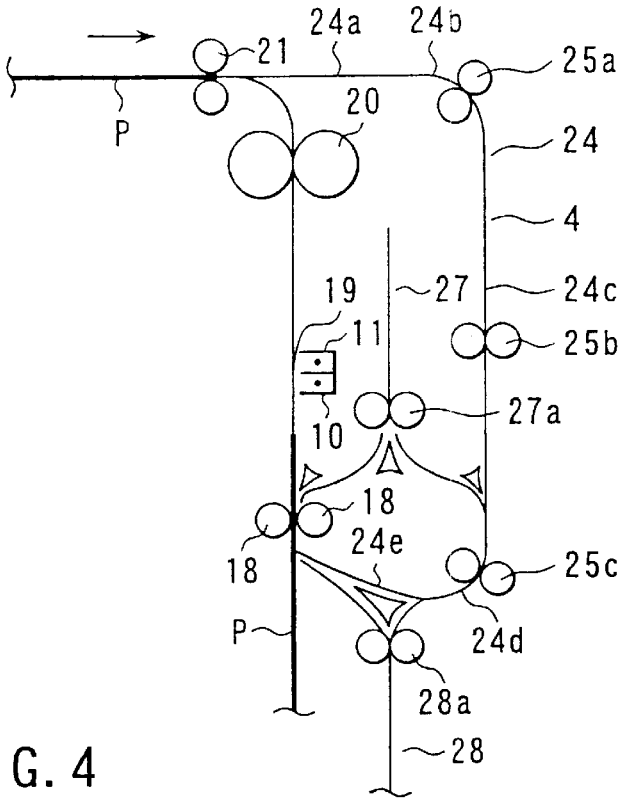
FIG. 4 is a view showing a state in which the paper sheet fed out from the image transfer section is being fed in the reverse direction, and a following paper sheet is being fed into the image transfer section.
Figure 5:
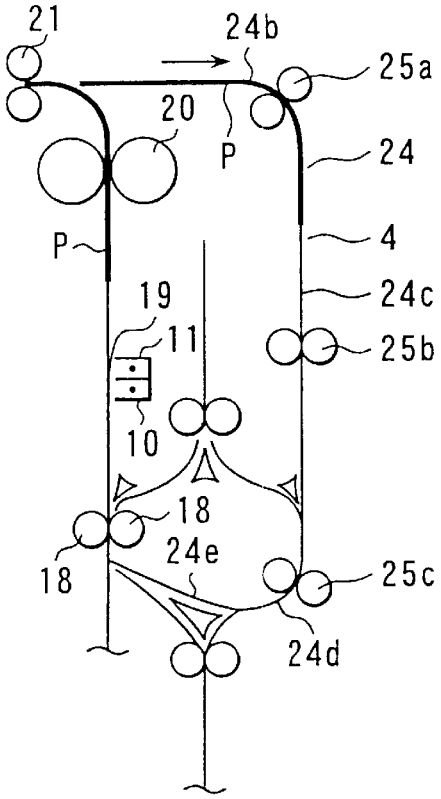
FIG. 5 is a view showing a state in which the paper sheet fed in the reverse direction is being fed into a reverse carrying route, and a following paper sheet is being fed out from the image transfer section with an image transferred thereto.
Figure 6:
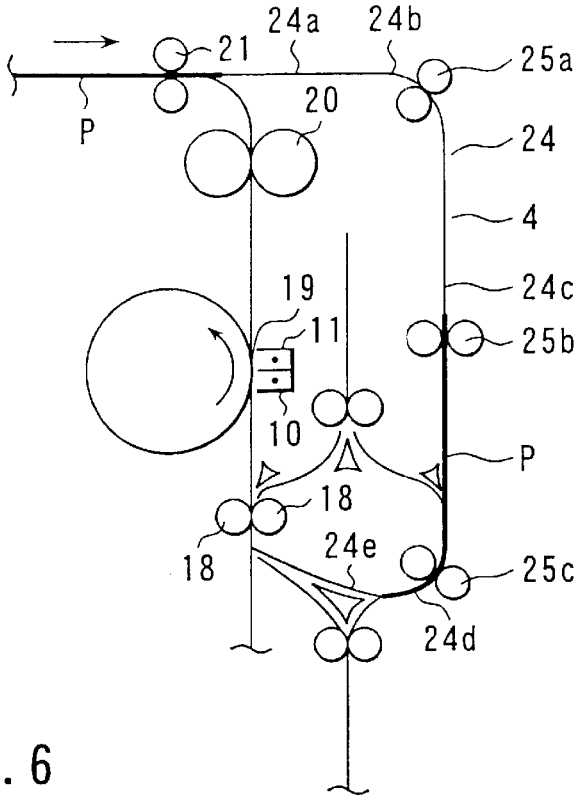
FIG. 6 is a view showing a state in which the paper sheet fed into the reverse carrying route is being carried, and the following paper sheet is being fed in the reverse direction.
Figure 7:
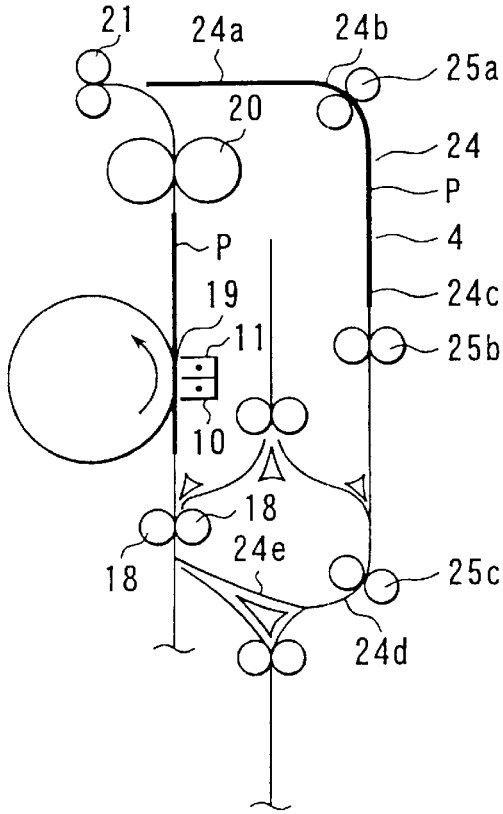
FIG. 7 is a view showing a state in which an image is being transferred to the back surface of the paper sheet fed out from the reverse carrying route, and the following paper sheet is being fed into the reverse carrying route and carried.

After the paper sheet P is fed by a predetermined amount, the paper sheet P is fed in the reverse direction, as shown in FIG. 4, and a following paper sheet P is carried along the feed carrying route 16. Subsequently, as shown in FIG. 5, the preceding paper sheet P is carried out along the reverse carrying route 24, and a toner image on the photosensitive drum 6 is transferred to the following paper sheet P which is then fed out. After the following paper sheet P is fed by a predetermined amount, it is also fed in the reverse direction as shown in FIG. 6 while the preceding paper sheet P is also carried continuously along the reverse carrying route 24. Thereafter, the preceding paper sheet P is fed into the image transfer section 19, reversed as shown in FIG. 7, and a toner image is transferred to the back surface thereof. The following paper sheet P is carried along the reverse carrying route 24.

Figure 8:
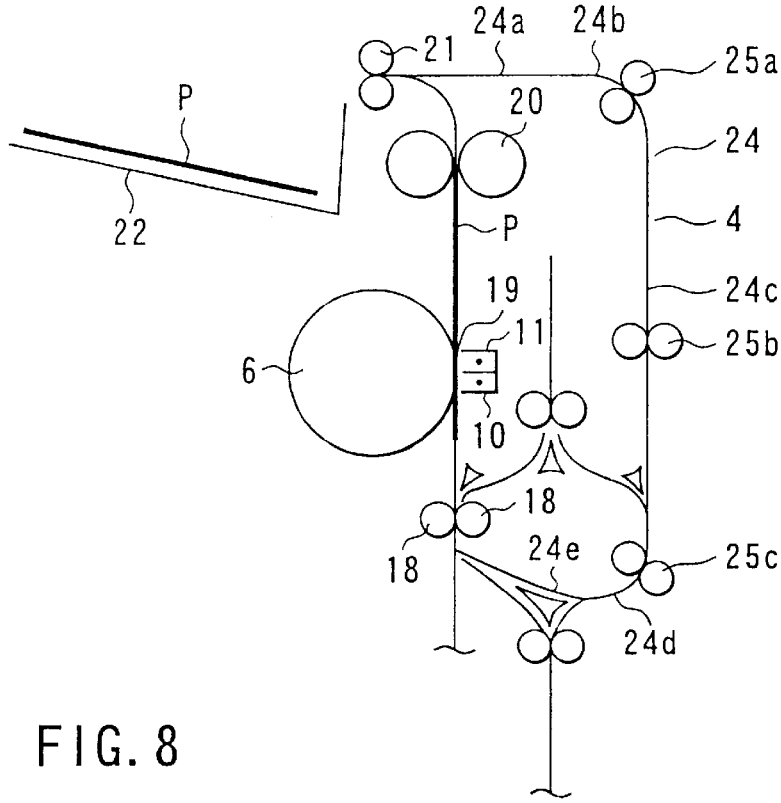
FIG. 8 is a view showing a state in which the paper sheet with an image formed on its back surface is being discharged onto a sheet discharge tray, and an image is being transferred to the back surface of the following paper sheet and carried.
Figure 9:
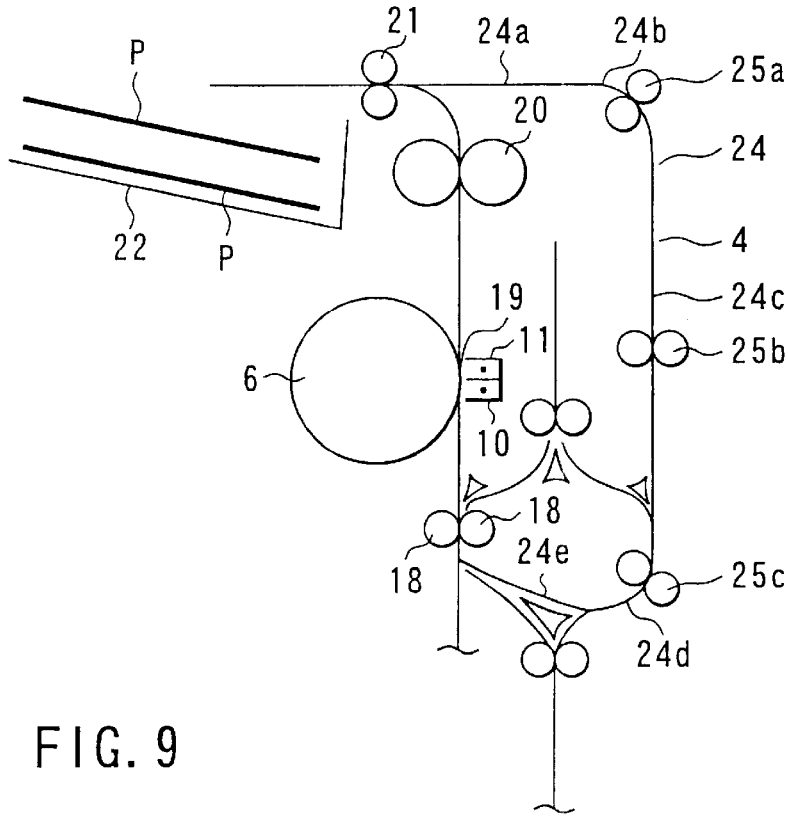
FIG. 9 is a view showing a state in which the following paper sheet with an image formed on its back surface is discharged onto the sheet discharge tray.

The preceding paper sheet P with a toner image transferred to its back surface passes through the paired fixing rollers 20, so that the toner image is fixed, and is then discharged onto the discharge tray 22, as shown in FIG. 8. At this time, the following paper sheet P reversed is fed to the image transfer section 19, and a toner image is transferred to its back surface. Thereafter, the following paper sheet P passes through the paired fixing rollers 20, so that the toner image is fixed, is then fed as shown in FIG. 9, and is carried out onto the discharge tray 22.

Meanwhile, there is a case that the above-described stack-less ADU is used with an accounting device such as a coin controller attached to the ADU. For example, if data of four pages should be printed on both surfaces of two paper sheets by an electrophotographic copying machine, there is a case that the inserted money runs short at the time point when printing of the first, second, and fourth pages is finished. In this case, the paper sheet is directly discharged without printing the third page to be printed, or is kept on the reverse carrying route 24.

However, it would be unkind to the user to discharge the paper sheets P without printing the third page.

Otherwise, if the paper sheet P is kept at corner parts 24*b* and 24*d*, it is curled.

Figure 11:
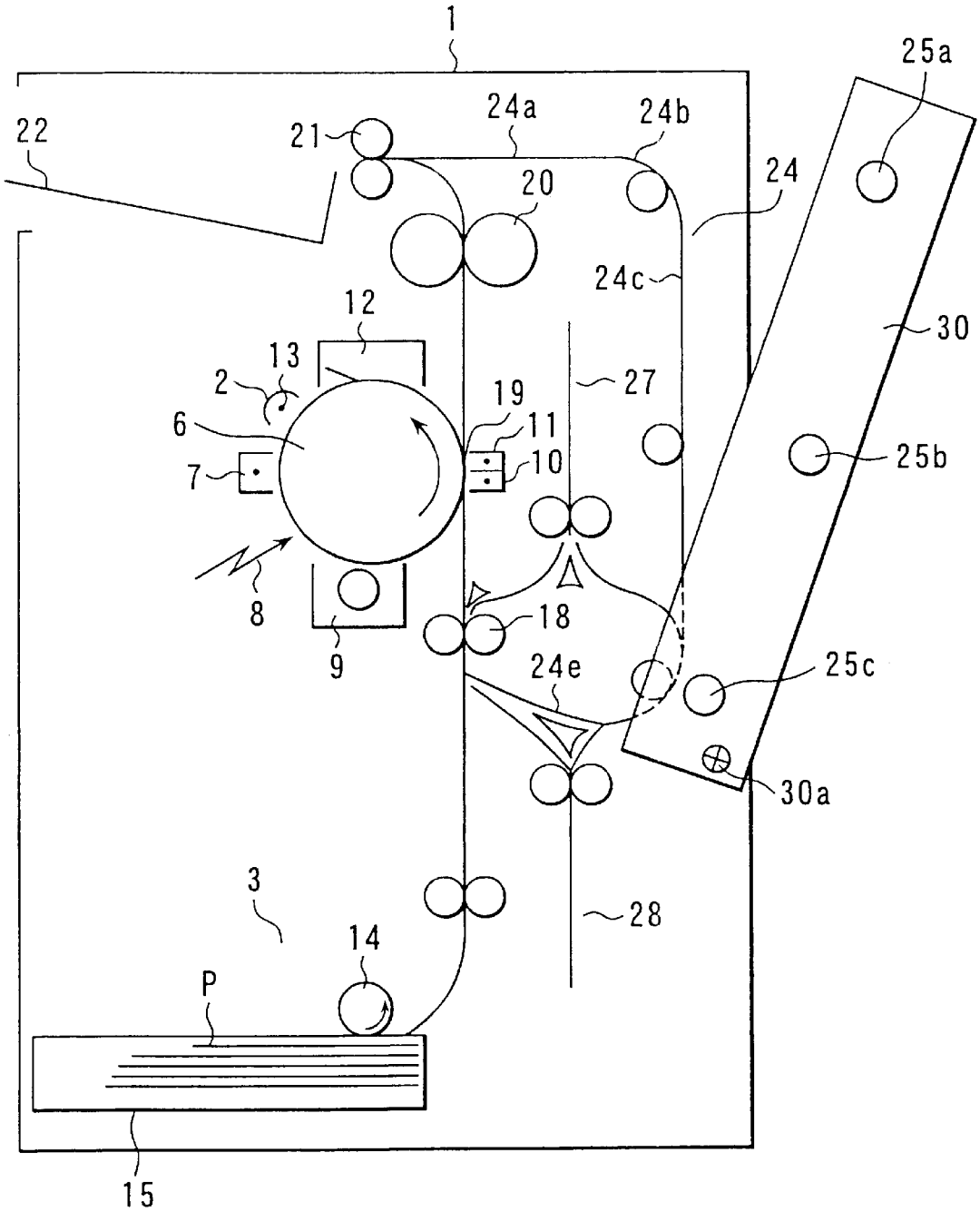
FIG. 11 is a view showing a state in which the open/close door is opened.

Further, if the reverse carrying route 24 is opened when the open/close door 30 is opened as shown in FIG. 11, the paired carrying rollers 25*a*, 25*b*, and 25*c* are apart from each other, so the paper sheet P kept on the reverse carrying route 24 falls down.

Hence, in the present invention, if inserted money runs short at the time point when printing is finished with respect to the first, second, and fourth pages, the paper sheet P on which the third page should be printed is escaped to the upper escape route 27, the lower escape route 28, or the horizontal part 24*a* of the reverse carrying part 24 to temporarily keep it.

Figure 12:
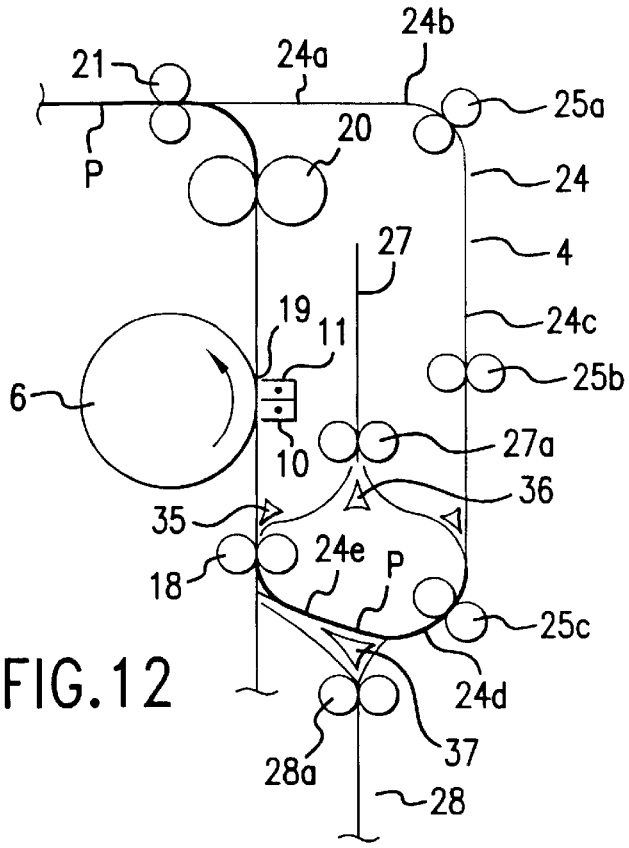
FIG. 12 is a view showing a first example of operation for letting a paper sheet escape.
Figure 13:
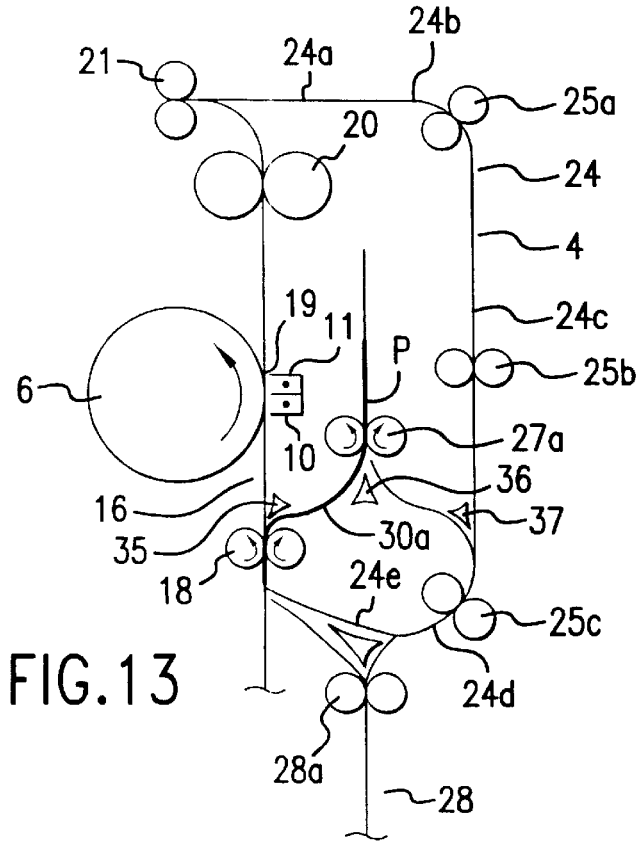
FIG. 13 is a view showing a state in which the paper sheet is fed to an upper escape part.
Figure 14:
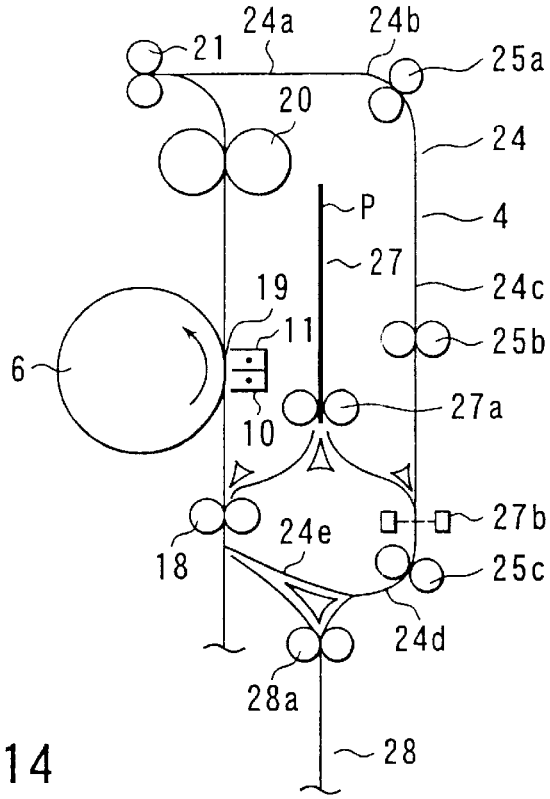
FIG. 14 is a view showing a state in which the paper sheet is escaped to the upper escape part.
Figure 15:
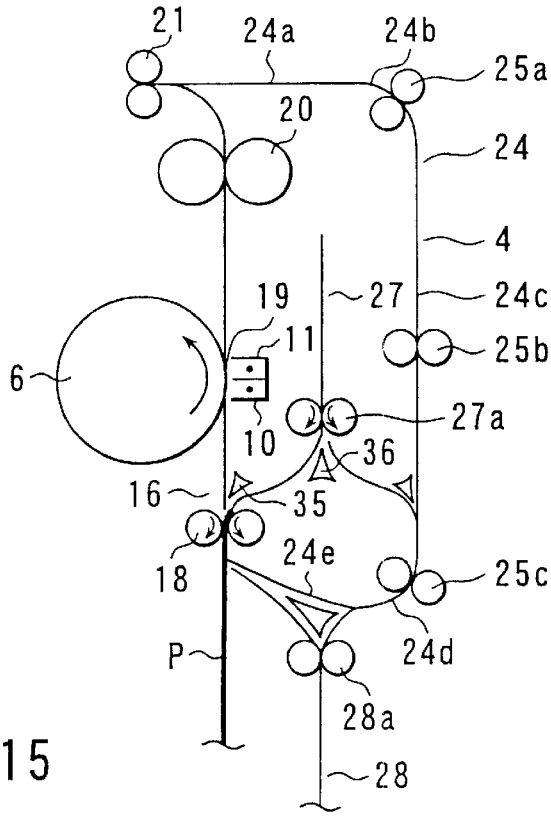
FIG. 15 is a view showing a state in which the escaped paper sheet is fed out toward an image transfer section.

FIGS. 12 to 14 show the case where a paper sheet P is escaped to the upper escape part 27.

In this case, the control device 46 receives a signal expressing a shortage of money from the fee counter 48, and then drives the gate drive section 44 to rotate the first gate 35. At this time, the control device 46 also drives the first and third drive sections 41 and 43, to regularly rotate the paired resist rollers 18 and also to regularly rotate the paired rollers 27*a* of the upper escape part 27. In this manner, the paper sheet P on which the third page should be printed is fed into the upper escape part 27 through the first connection route 30*a* as shown in FIGS. 12 to 13, and is escaped and kept, as shown in FIG. 14.

Figure 16:
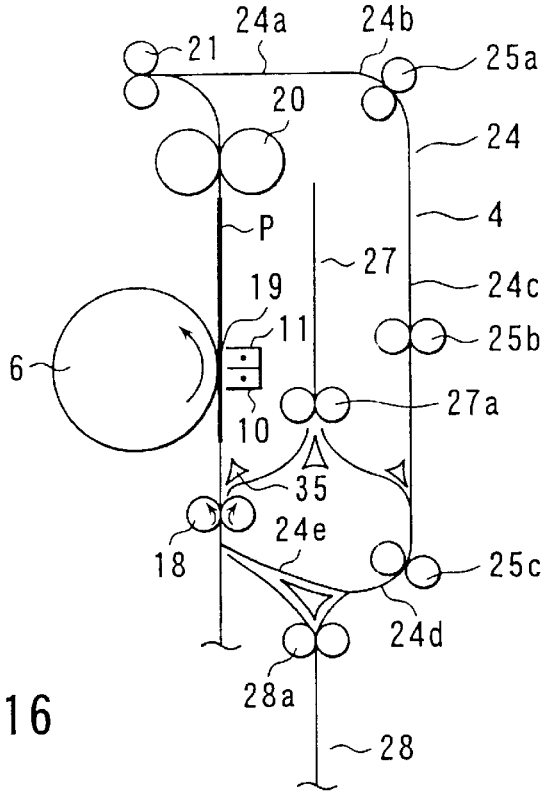
FIG. 16 is a view showing a state in which an image is being transferred to a paper sheet which has been fed to the image transfer section.

When money is added again after the paper sheet is thus kept, a signal expressing it is transmitted to the control device 46 from the fee counter 48. In this manner, the paired rollers 27*a* of the upper escape part 27 and the paired resist rollers 18 on the main carrying route 16 are rotated in the reverse direction, so that the paper sheet P is fed from the escape part 27 and is once fed to the main carrying route 16. Thereafter, the paired resist rollers 18 are rotated regularly so that the paper sheet P is fed into the image transfer section 19, as shown in FIG. 16, and the third page is printed on its back surface.

Figure 17:
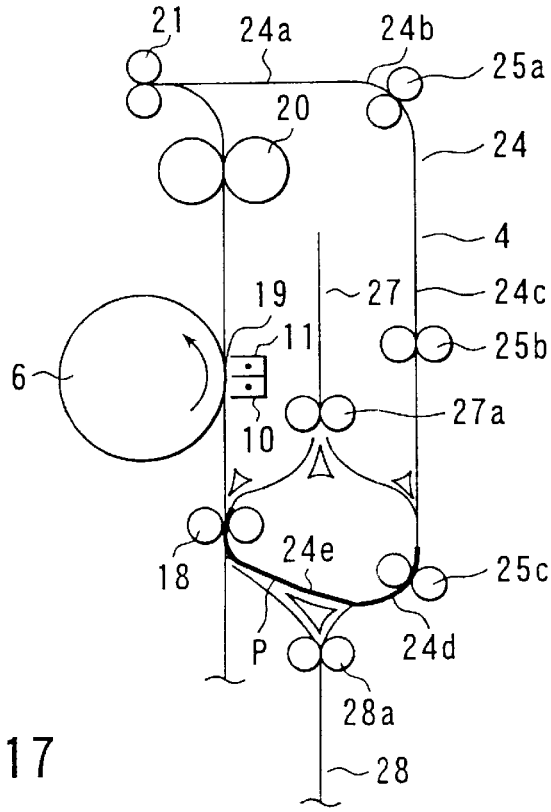
FIG. 17 is a view showing a second example of an operation for letting a paper sheet escape.
Figure 18:
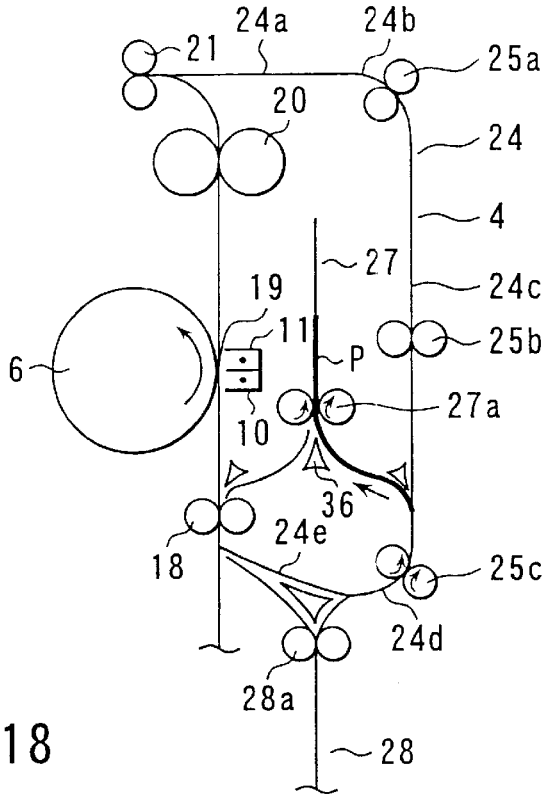
FIG. 18 is a view showing a state in which the paper sheet is fed to an upper escape part.
Figure 19:
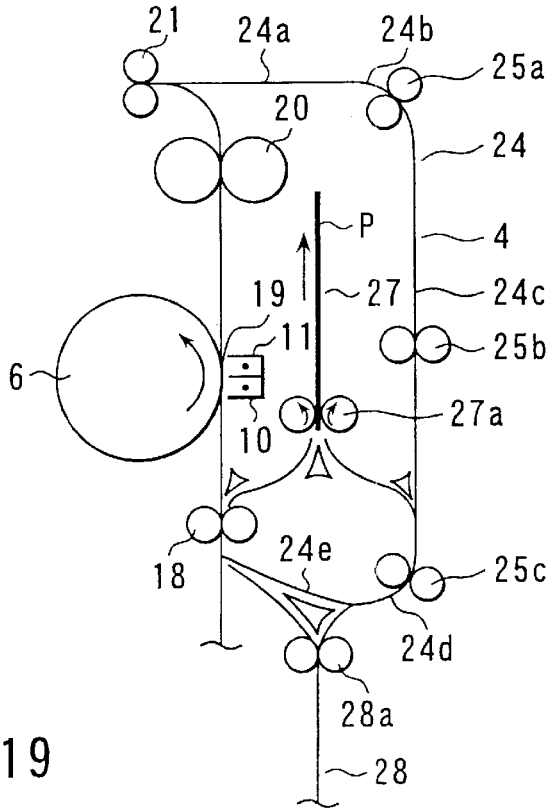
FIG. 19 is a view showing a state in which the paper sheet is let escape to the upper escape part.
Figure 20:
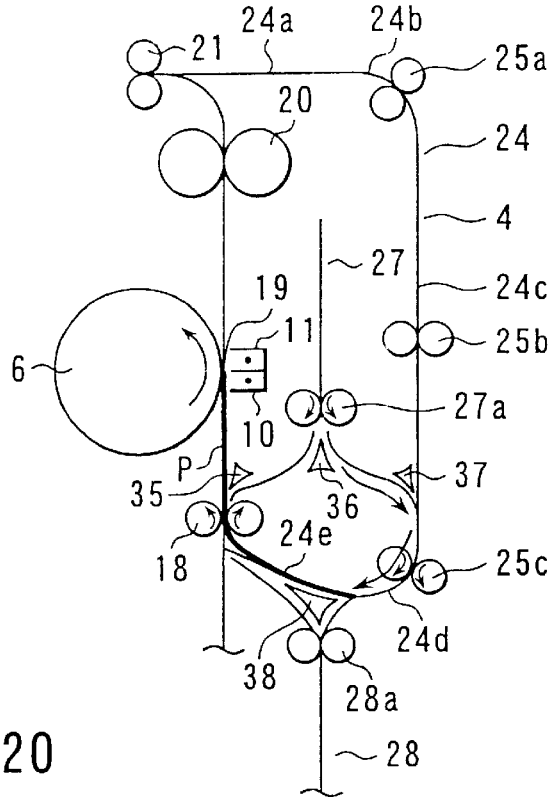
FIG. 20 is a view showing a state in which the escaped paper sheet is fed out toward an image transfer section.

FIGS. 17 to 19 show another example where a paper sheet P is escaped to the upper escape part 27.

In this case, in the state shown in FIG. 17, the control device 46 receives a signal expressing a shortage of money from the fee counter 48, and then drives the gate drive section 44 to rotate the second and third gates 36 and 37 and also to drive the second and third drive sections 42 and 43 to rotate the paired carrying rollers 25*c* and the paired rollers 27*a* of the upper escape part 27 in the reverse direction. By this reverse rotation, the paper sheet P on which the third page should be printed is fed to the upper escape part 27 through the second connection route 31, as shown in FIG. 18, and is escaped and kept, as shown in FIG. 19.

When money is added again after the paper sheet is thus kept, a signal expressing it is transmitted to the control device 46 from the fee counter 48. By this transmission, the paired rollers 27*a* of the upper escape part 27 are rotated in the reverse direction and the paired carrying rollers on the reverse carrying route 24 and the paired resist rollers 18 on the main carrying route 16 are rotated in the regular direction. Further, the first and fourth gates 35 and 38 are rotated. In this manner, the paper sheet P is fed out from the upper escape part 27, as indicated by an arrow, and is fed to the image transfer section 19 through the third gate 37 and the fourth gate 38. Then, the third page is printed on its back surface.

Figure 21:
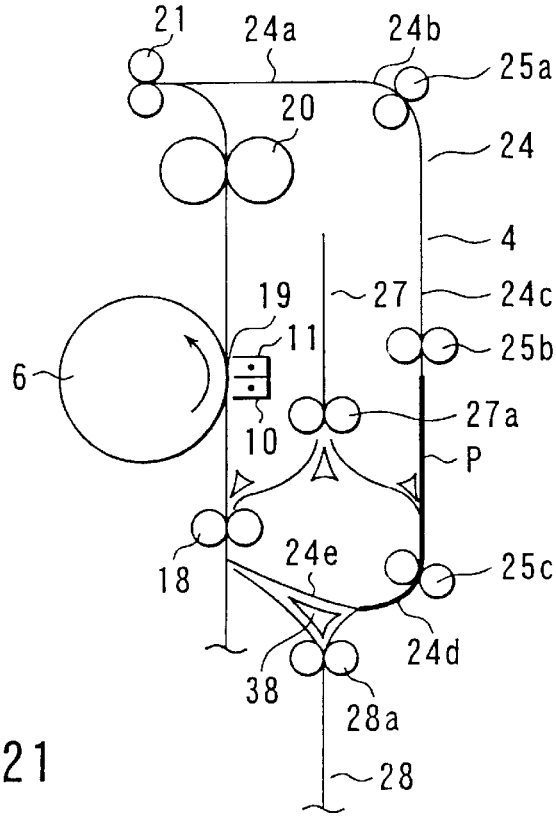
FIG. 21 is a view showing a third example of an operation for letting a paper sheet escape.
Figure 22:
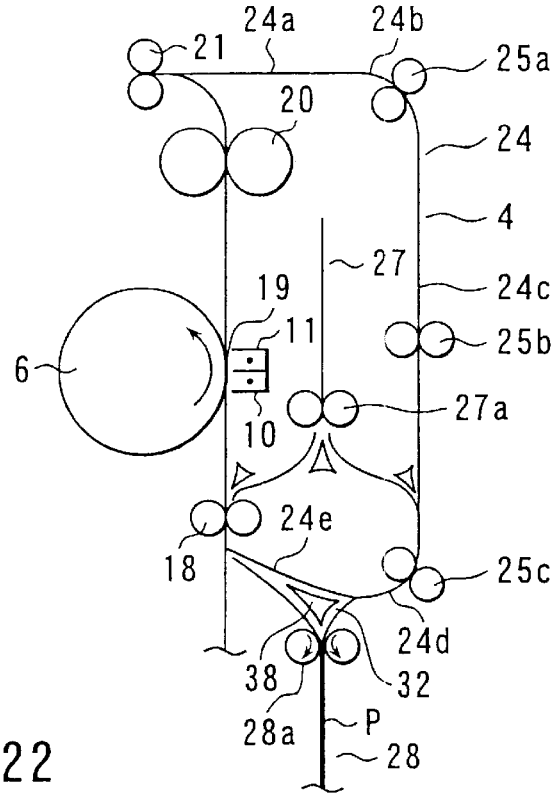
FIG. 22 is a view showing a state in which the paper sheet is escaped to a lower escape part.

FIGS. 21 and 22 show a case where a paper sheet P is escaped to the lower escape part 28.

In this case, the control device 46 receives a signal expressing a shortage of money from the fee counter 48, in the state shown in FIG. 21. By receiving this signal, the control device 46 drives the gate drive section 44 to rotate the fourth gate 38 and also drives the third drive section 43 to rotate the paired carrying rollers 28*a* of the lower escape part 28 in the regular direction. In this manner, as shown in FIG. 22, the paper sheet P on which the third page should be printed is fed into the lower escape part 28 through the third connection route 32, and is escaped and kept.

Figure 23:
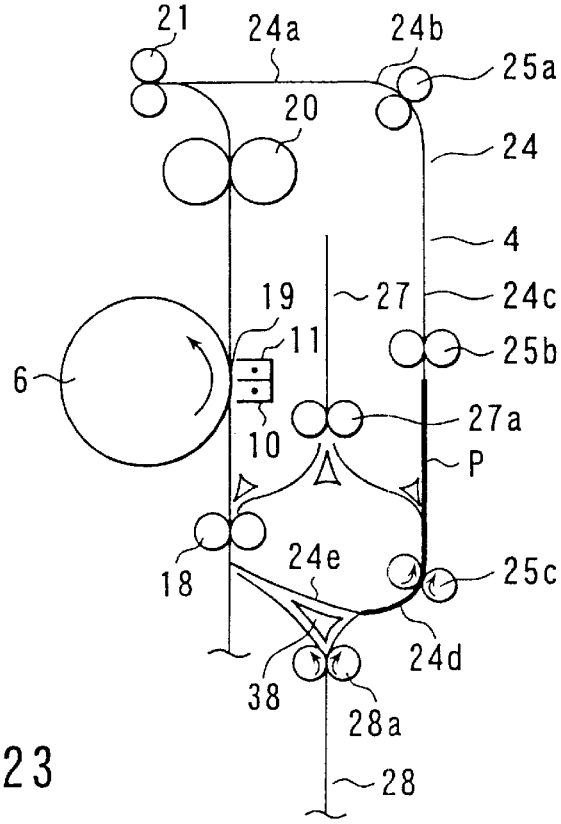
FIG. 23 is a view showing a state in which the paper sheet is fed out from the lower escape part.
Figure 24:
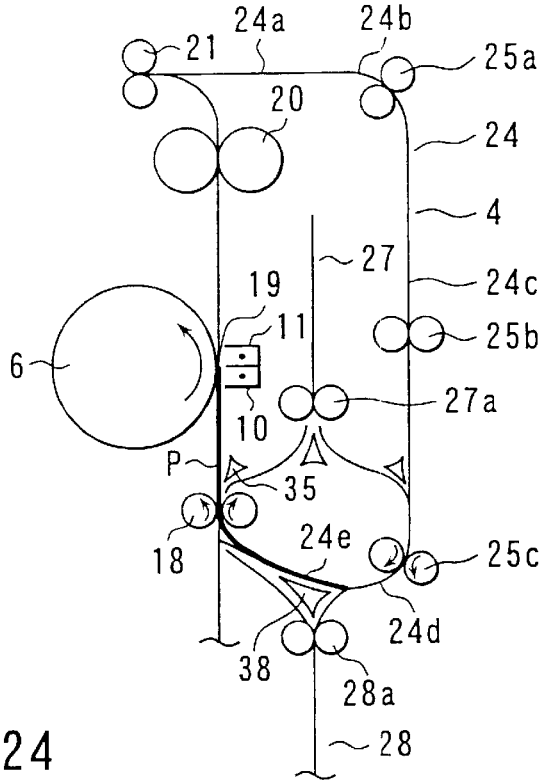
FIG. 24 is a view showing a state in which the paper sheet fed out from the lower escape part is fed out toward an image transfer section.

When money is added again after the paper sheet is thus kept, a signal expressing it is transmitted to the control device 46 from the fee counter 48. By this transmission, the paired rollers 28*a* of the lower escape part 28 are rotated in the reverse direction, as shown in FIG. 23, and the paired carrying rollers 25*c* on the reverse carrying route 24 are rotated in the reverse direction, so that the paper sheet P is fed back by a predetermined amount into the reverse carrying route 24 from the lower escape part 28. Thereafter, as shown in FIG. 24, the paired carrying rollers 25*c* on the reverse carrying route 24 are rotated regularly and the fourth gate 38 is rotated, so that the paper sheet P is fed to the image transfer section 19 through the fourth gate 38 and the first gate 35, and the third page is printed on its back surface.

FIGS. 25 to 28 show a case where a paper sheet P is escaped to the horizontal part 24*a* on the reverse carrying route 24.

Figure 25:
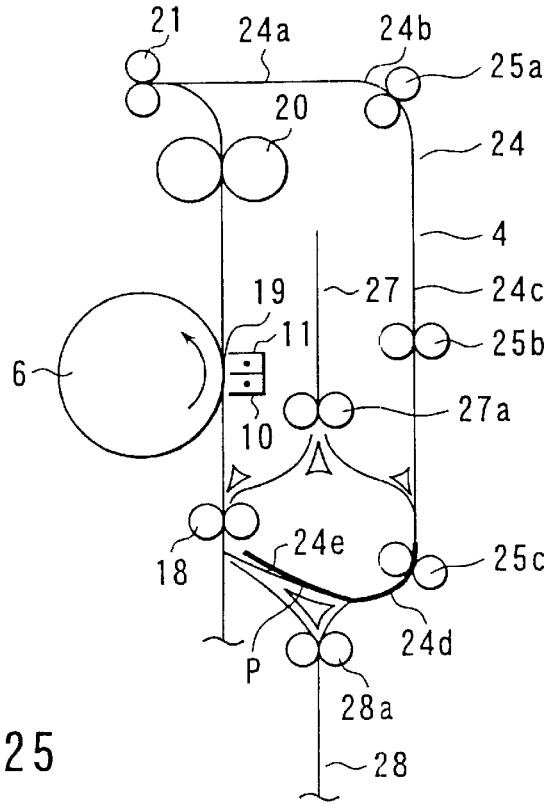
FIG. 25 is a view showing a fourth example of operation for letting a paper sheet escape.
Figure 26:
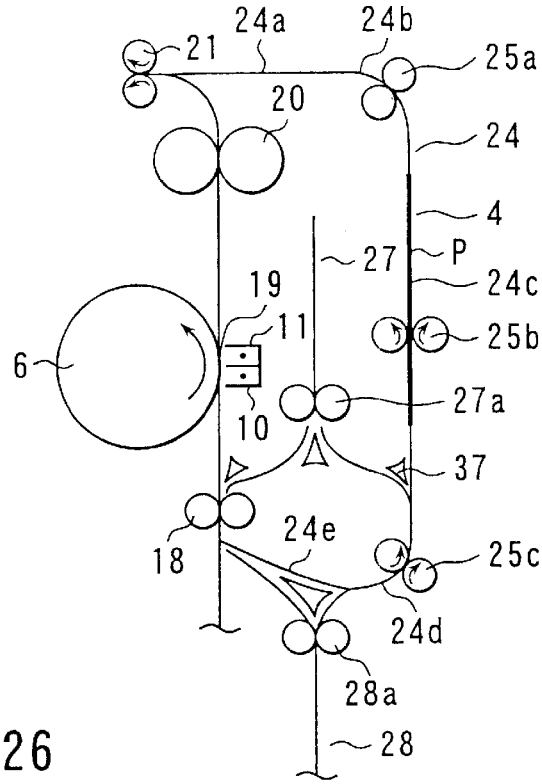
FIG. 26 is a view showing a state in which the paper sheet is fed in the reverse direction along a reverse carrying route.
Figure 27:
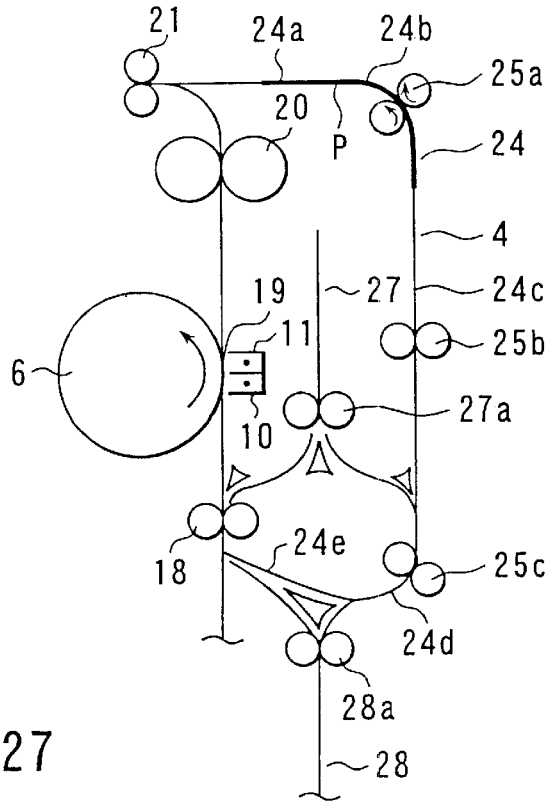
FIG. 27 is a view showing a state in which the paper sheet is further fed in the reverse direction along the reverse carrying route.
Figure 28:
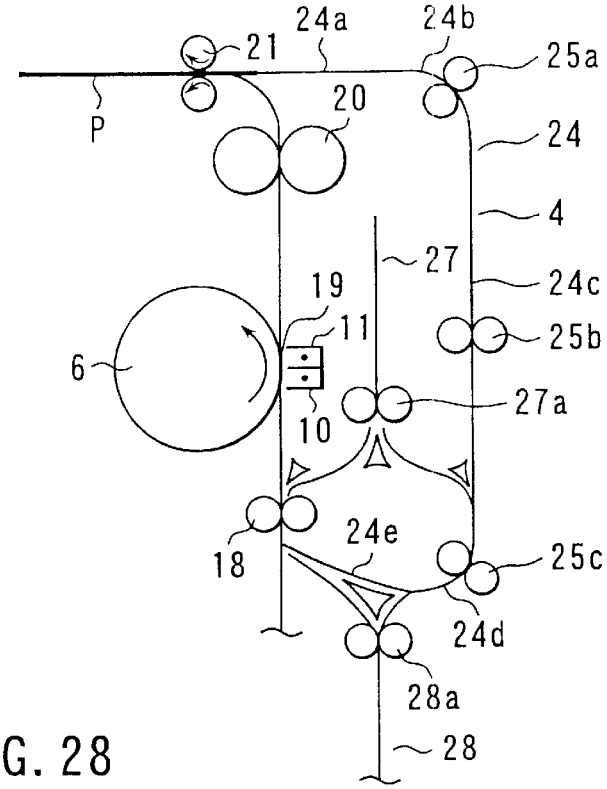
FIG. 28 is a view showing a state in which the paper sheet is escaped to a horizontal part of the reverse carrying part.

In this case, the control device 46 receives a signal expressing a shortage of money from the fee counter 48, in the state shown in FIG. 25. By receiving this signal, the control device 46 drives the second drive section 43 to rotate the paired carrying rollers 24*a* to 24*c* on the reverse carrying route 24, in the reverse direction, and also drives the first drive section 41 to rotate regularly the paired discharge rollers 21. In this manner, as shown in FIGS. 26 and 27, the paper sheet P on which the third page should be printed is fed back on the reverse carrying route 24, and is thereafter let escape and kept as shown in FIG. 28.

Figure 29:
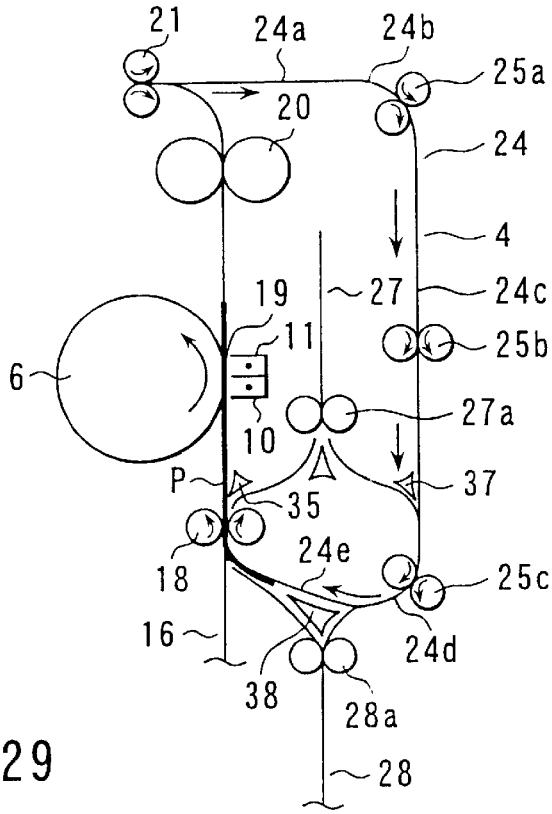
FIG. 29 is a view showing a state in which the escaped paper sheet is fed into the image transfer section.

When money is added again after the paper sheet is thus kept, a signal expressing it is transmitted to the control device 46 from the fee counter 48. By this transmission, the paired discharge rollers 21 are rotated in the reverse direction, as shown in FIG. 29, and the paired carrying rollers 24*a* to 24*c* on the reverse carrying route 24 and the paired resist rollers 18 are rotated regularly. In this manner, the paper sheet P is carried as indicated by the arrow to the reverse carrying route 24 though the third gate 37, the fourth gate 38, and the first gate 35. The lower escape part 28, and the third page is printed on its back surface.

FIGS. 30 to 33 show another case where a paper sheet P is escaped to the horizontal part 24*a* on the reverse carrying route 24.

Figure 30:
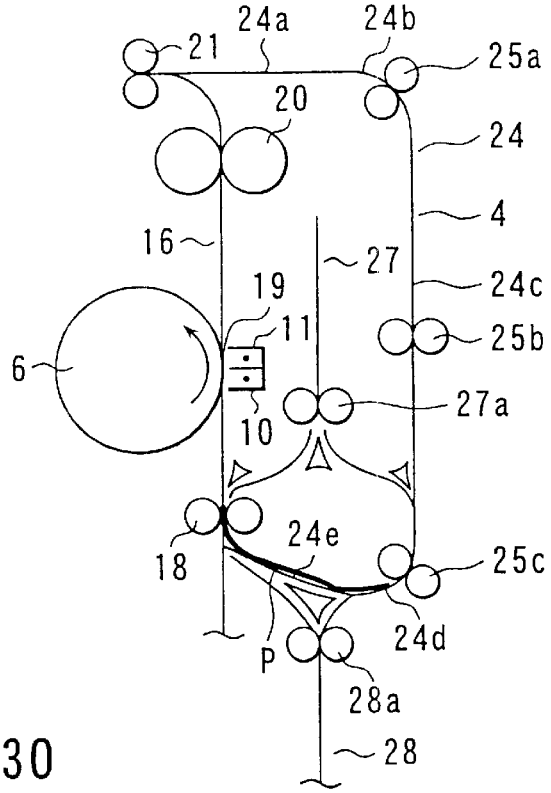
FIG. 30 is a view showing a fifth example of an operation for letting a paper sheet escape.
Figure 31:
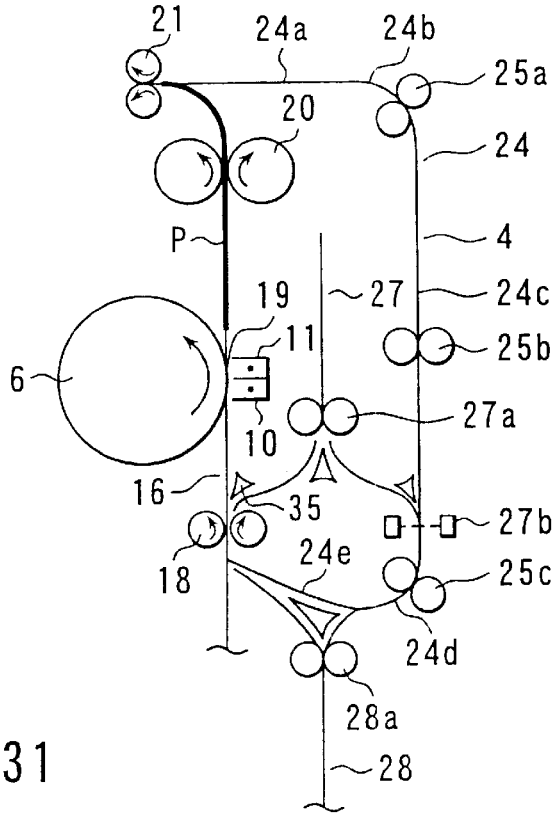
FIG. 31 is a view showing a state in which the paper sheet is carried along a main carrying route.
Figure 32:
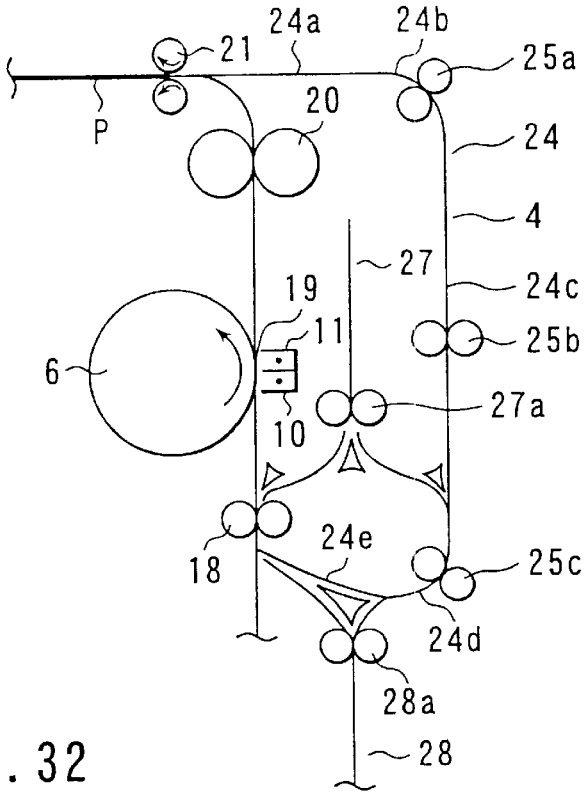
FIG. 32 is a view showing a state in which the paper sheet is fed out by a predetermined amount from discharge rollers.
Figure 33:
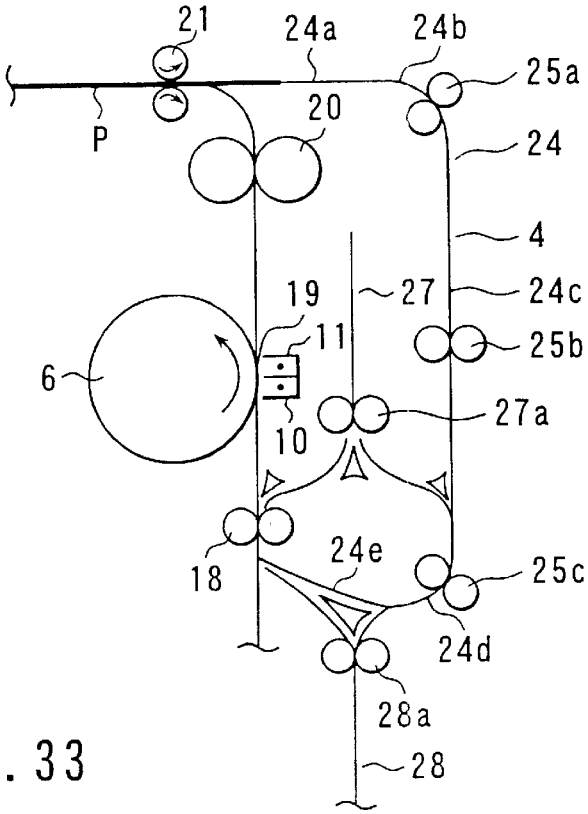
FIG. 33 is a view showing a state in which the paper sheet escaped to a horizontal part of the reverse carrying route.

In this case, the control device 46 receives a signal expressing a shortage of money from the fee counter 48, in the state shown in FIG. 30. By receiving this signal, the control device 46 drives the first drive section 43 to rotate regularly the paired resist rollers 18, the paired fixing rollers 20, and the paired discharge rollers 21. In this manner, the paper sheet P is carried along the main carrying route 16, and is fed by a predetermined amount from the paired discharge rollers 21, as shown in FIG. 32. Then, the paired discharge rollers 21 are rotated in the reverse direction, as shown in FIG. 33, and is escaped and kept in the horizontal part 24*a* on the reverse carrying route 24.

Figure 34:
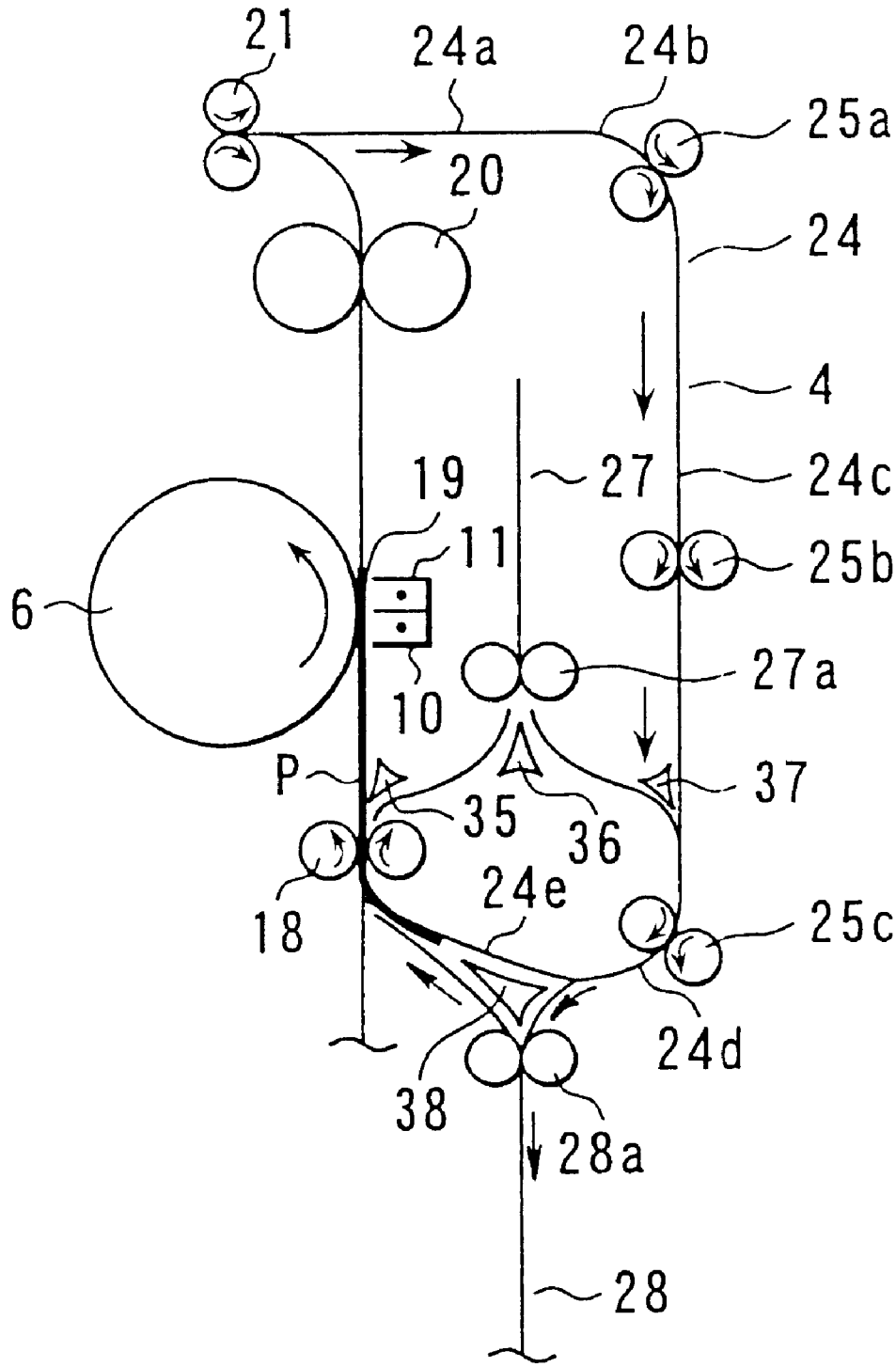
FIG. 34 is a view showing a state in which the escaped paper sheet is fed into the image transfer section.

When money is added again after the paper sheet is thus kept, a signal expressing it is transmitted to the control device 46 from the fee counter 48. By this transmission, the paired discharge rollers 21 are rotated in the reverse direction, as shown in FIG. 34. The paired carrying rollers 24*a* to 24*c* on the reverse carrying route 24 and the paired resist rollers 18 on the main carrying route 16 are rotated in the forward direction. The paper sheet P is therefore fed to the image forming section 19 as indicated by the arrow along the lower escape part 28 and through the nip between the resist rollers 18. The third page is printed on its back surface.

As has been explained above, when inserted money runs short, the paper sheet P is escaped to the straight upper and lower escape part 27 or 28 or to the straight horizontal part 24*a* on the reverse carrying route 24.

Accordingly, printing can be achieved without directly discharging an unprinted paper sheet, or a paper sheet P falling upon opening the open/close door 30, or curling of a paper sheet P, unlike a conventional apparatus.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A carrying apparatus comprising:

a supply device which supplies a transfer object, an image-forming device which forms an image on the transfer object supplied by the supplying device and carried, a fixing device provided downstream of the image forming device in a carrying direction of the transfer object, the fixing device fixing the image on the transfer object;

a first carrying route which carries the transfer object by the supplying device to the fixing device;

a second carrying route which carries the transfer object having one surface to which the image has been fixed by the fixing device, from a down stream side of the fixing device in the carrying direction of the transfer object to an upstream side of the image forming device in the carrying direction of the transfer object; and an escape part which is provided inside the carrying route connecting the first and second carrying routes and between the first and second carrying routes and in which the transfer object having one surface to which the image has been fixed by the fixing device and carried through the second carrying route is temporarily escaped.

2. The carrying apparatus according to claim 1, wherein the escape part has a straight part.

3. The carrying apparatus according to claim 1, wherein the escape part to which the transfer object is escaped is closed on a back side thereof.

4. The carrying apparatus according to claim 1, wherein the escape part includes normal/reverse rotation rollers to escape the transfer object thereto.

5. The carrying apparatus according to claim 1, wherein the escape part is configured to not reverse a surface of the transfer object.

6. An image forming apparatus comprising:

supplying means for supplying a transfer object;

image-forming means for forming an image on the transfer object supplied by the supplying means;

fixing means provided downstream of the image forming means in a carrying direction of the transfer object, for fixing the image on the transfer object;

first carrying means for carrying the transfer object supplied by the supplying means to the fixing means along the first carrying route;

second carrying means for carrying the transfer object having one surface to which the image has been fixed by the fixing means from a down stream side of the fixing device in the carrying direction of the transfer object to an upstream side of the image forming means in the carrying direction of the transfer object, and escape means which is provided inside the carrying route connecting the first and second carrying routes and between the first and second carrying routes, for temporarily escaping the transfer object having one surface to which the image has been fixed by the fixing device and carried through the second carrying route.

7. The image forming apparatus according to claim 6, wherein the escape means is configured to not reverse a surface of the transfer object.

8. An image forming method comprising:

supplying a transfer object by supplying means;

forming an image on the transfer object supplied by the supplying means by image forming means;

fixing the image on the transfer object by fixing means provided downstream of the image forming means in a carrying direction of the transfer object;

carrying the transfer object supplied by the supplying means to the fixing means along a first carrying route;

carrying the transfer object having one surface of which the image has been fixed by the fixing means from a downstream side of the fixing device in the carrying direction of the transfer object to an upstream side of the image forming means in the carrying direction of the transfer object, along a second transfer route, and temporarily escaping the transfer object having one surface of which the image has been fixed by the fixing means and carried along the second transfer route in escaping means which is provided inside the carrying route connecting the first and second carrying routes and between the first and second carrying routes.

9. The image forming method according to claim 8, wherein the step of temporarily escaping the transfer object does not reverse a surface of the transfer object.

* * * * *